United States Patent [19]

Ishizaki et al.

[11] Patent Number: 4,646,622

[45] Date of Patent: Mar. 3, 1987

[54] HYDRAULIC CONTROL APPARATUS

[75] Inventors: Naoki Ishizaki, Kamakura; Sadao Nunotani, Hiratsuka; Tatsumi Tada, Kawasaki; Kazuo Uehara, Tokyo; Shuki Akushicki, Fujisawa, all of Japan

[73] Assignee: Kabushiki Kaisha Komatsu Seisakusho, Tokyo, Japan

[21] Appl. No.: 800,188

[22] Filed: Nov. 21, 1985

[30] Foreign Application Priority Data

Nov. 22, 1984 [JP] Japan ..... 59-245876

[51] Int. Cl.[4] ..... F15B 13/043

[52] U.S. Cl. ..... 91/446; 91/454; 91/461; 137/596.16

[58] Field of Search ..... 91/446, 454, 461; 137/596.16

[56] References Cited

U.S. PATENT DOCUMENTS 4,201,052 5/1980 Breeden et al. .
4,535,809 8/1985 Anderson .

*Primary Examiner*—Gerald A. Michalsky
*Attorney, Agent, or Firm*—Armstrong, Nikaido, Marmelstein & Kubovcik

[57] ABSTRACT

A hydraulic control apparatus has at least two meter-in and two meter-out poppet valves. In order to be compact and deal with a great flow rate, the apparatus is arranged such that a pair of meter-in poppet valves and load check valves are located in an upper horizontal plane, a pair of meter-out poppet valves and solenoid-actuated pilot valves are located in a lower horizontal plane, and a pair of a pilot valve associated with the meter-out poppet valve and a reducing valve associated with the meter-in poppet valve are located in a middle horizontal plane and are respectively disposed in opposed relationship to each other, and the load check valve is vertically located in parallel relationship with the meter-out poppet valve.

3 Claims, 7 Drawing Figures

HYDRAULIC CONTROL APPARATUS

BACKGROUND OF THE INVENTION

1. Field of the Invention:

This invention relates to a hydraulic control apparatus including poppet valves, and more particularly to such a hydraulic control apparatus for controlling a plurality of actuators such as hydraulic cylinder means adapted to drive work implements mounted on heavy excavators and cranes.

2. Description of the Prior Art:

In the past, there has been employed a hydraulic control apparatus of the kind specified which comprises at least two sets of meter-in poppets and at least two sets of meter-out poppets mounted in a valve body in such a manner that their outer peripheral sides are located in their primary ports and their leading ends are located in their secondary port. Each of the poppets is arranged to be opened and shut freely through a pilot valve adapted to be actuated by the control signal generated and transmitted by a controller in proportion to the manipulated variable produced by a group of operating levers. The primary side ports of the meter-in poppets is connected to a variable displacement pump and their secondary ports are respectively connected through respective load check valves to the primary side ports of said meter-out poppets and at least one actuator. The pilot piston slidably mounted in each of the pilot valves is formed with a passage which is arranged, at neutral position thereof, to release the fluid pressure in the port of the meter-out poppet valve that corresponds to the control signal.

However, such a hydraulic control apparatus tends to become large-sized and expensive in manufacturing cost without proper arrangements of the poppet valves and pilot valves.

Further, the hydraulic control systems disclosed in U.S. Pat. Nos. 4,201,052 and 4,535,809 are not suitable for use as those which require hydraulic fluid to flow therethrough at high flow rates in hydraulic cylinders mounted in large-sized excavators.

SUMMARY OF THE INVENTION

The present invention has been devised in view of the above-mentioned circumstances in the prior art apparatuses or systems, and has for its object to provide a compact, small-sized and inexpensive hydraulic control apparatus capable of meeting the requirement to handle hydraulic fluid at great flow rates with proper arrangements of poppet valves and pilot valves contained therein.

To achieve the above-mentioned object, in accordance with the present invention, there is provided a hydraulic control apparatus which comprises at least two sets of meter-in poppet valves mounted in a valve body in such a manner that the outer peripheral sides of the poppet valves are located in their respective hydraulic fluid supply ports communicating with a variable displacement pump. At least two sets of meter-out poppet valves whose outer peripheral sides are located in their respective secondary inlet ports, with each of which the delivery side at the leading end of each of the meter-in poppet valves are allowed to communicate through a load check valve. Each of the meter-out poppet valves is mounted in the valve body to form a pair with each of the meter-in poppet valves. Solenoid-actuated pilot valves are associated with the meter-in poppet valves in cooperation with a reducing valve. The solenoid-actuated pilot valves are actuated by an output signal transmitted by a controller arranged to be rendered operative in proportion to the manipulated variable produced by a group of operating levers so as to open and shut each of the meter-in poppet valves freely. Pilot valves are associated with each of the meter-out poppet valves so as to control the fluid pressure within each of the meter-out poppet valves. The outer peripheral sides of the meter-out poppet valves are connected to at least one actuator to pair of each of said meter-in poppet valves and each of said load check valves are disposed in an upper horizontal plane. A pair of each of the meter-out poppet valves, and each of the solenoid-actuated pilot valves associated respectively with the meter-in poppet valves, each of which is arranged at the opposite side to each of the solenoid-actuated pilot valves, this pair of valves being disposed in a lower horizontal plane. A pair of each of the pilot valves associated respectively with the meter-out poppet valves and each of the reducing valves associated respectively with the meter-in poppet valves each of which is arranged at the opposite side to each of the reducing valves, this pair of valves being disposed in a middle horizontal plane between the upper and lower ones are each located in opposed relationship to each other. Each of the load check valves is vertically located in parallel relationship with each of the meter-out poppet valves by the interposition of said pilot valves, respectively, the arrangement being made such that the fluid pressure within one of the meter-in poppet valves is allowed to be directed into the inlet valve of one of the reducing valves associated with the other meter-in poppet valve and flow through the solenoid-actuated pilot valve associated with the one of the reducing valves back again into the leading end of the latter from where it is allowed to flow into the region opposite to and between the one of said meter-in poppet valves and one of said load check valves.

Further, in accordance with the present invention, there is provided a hydraulic control apparatus characterized in that the passage for directing the fluid pressure within each of the meter-in poppet valves into the region opposite to and between the one of the meter-in poppet valves and the one of the load check valves extends along a diagonal line between the one of the meter-in poppet valves and one of the reducing valves which is arranged at the opposite side to the one of the meter-in poppet valves.

Still further, in accordance with the present invention, there is provided a hydraulic control apparatus, characterized in that a control valve means comprising a pilot spool adapted to be controlled for movement between an inlet port communicating with a pressure chamber within each of the meter-in poppet valves and another port communicating through a fixed restrictor with the region opposite to and between each of the meter-out poppet valves. Each of the solenoid-actuated pilot valves is used in place of a pair of one reducing valve and one solenoid-actuated pilot valve for controlling opening and shutting of each of the meter-in poppet valves.

The above and many other advantages, features and additional objects of the present invention will become apparent to those skilled in the art upon making reference to the following detailed description and accompanying drawings in which preferred structural embodiments incorporating the principles of the present invention are shown by way of illustrative example.

DETAILED DESCRIPTION OF THE INVENTION

Figure 1:
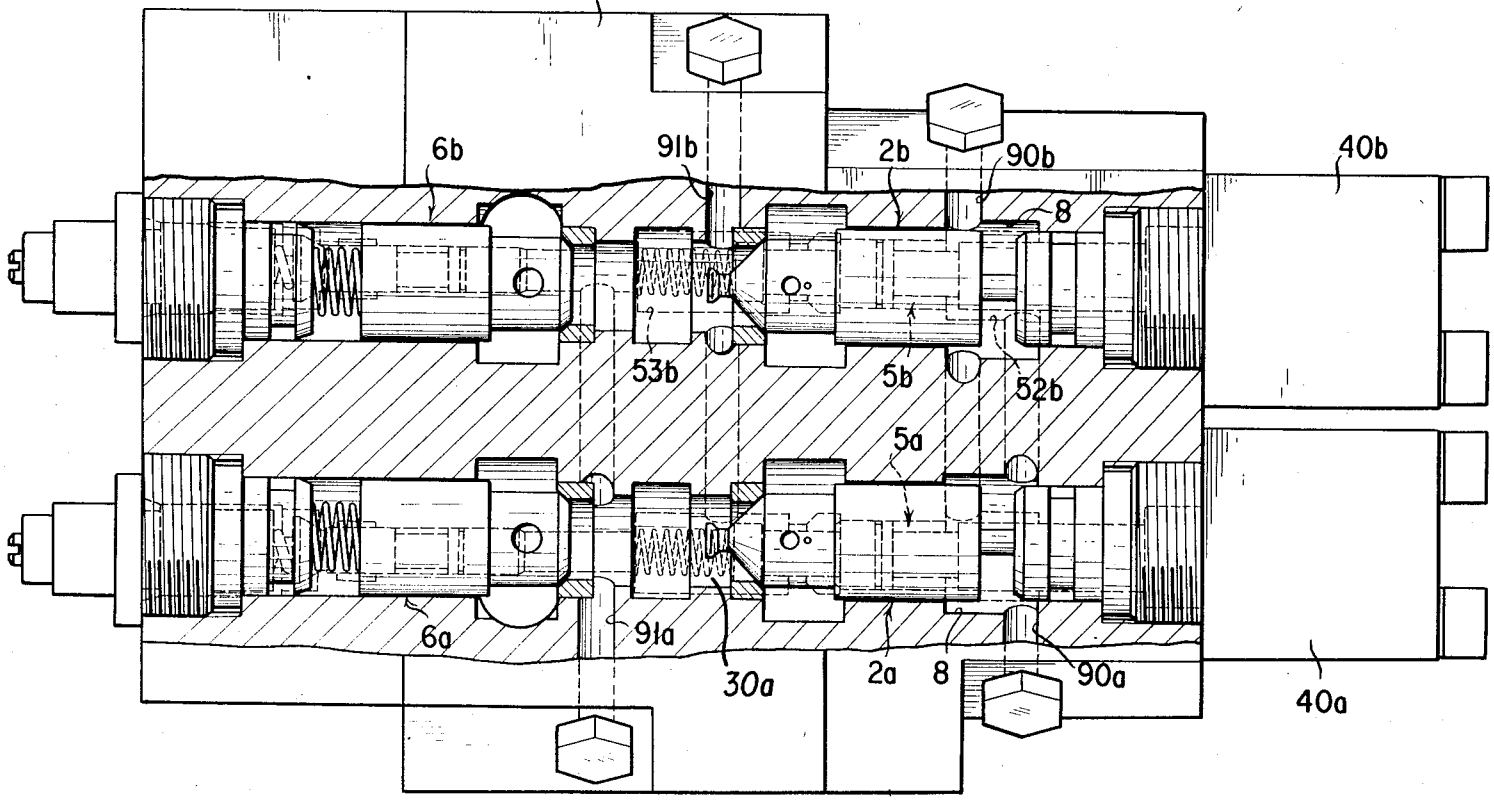
FIG. 1 is a schematic plan view illustrating the valve body of the hydraulic control apparatus according to the present invention.
Figure 2:
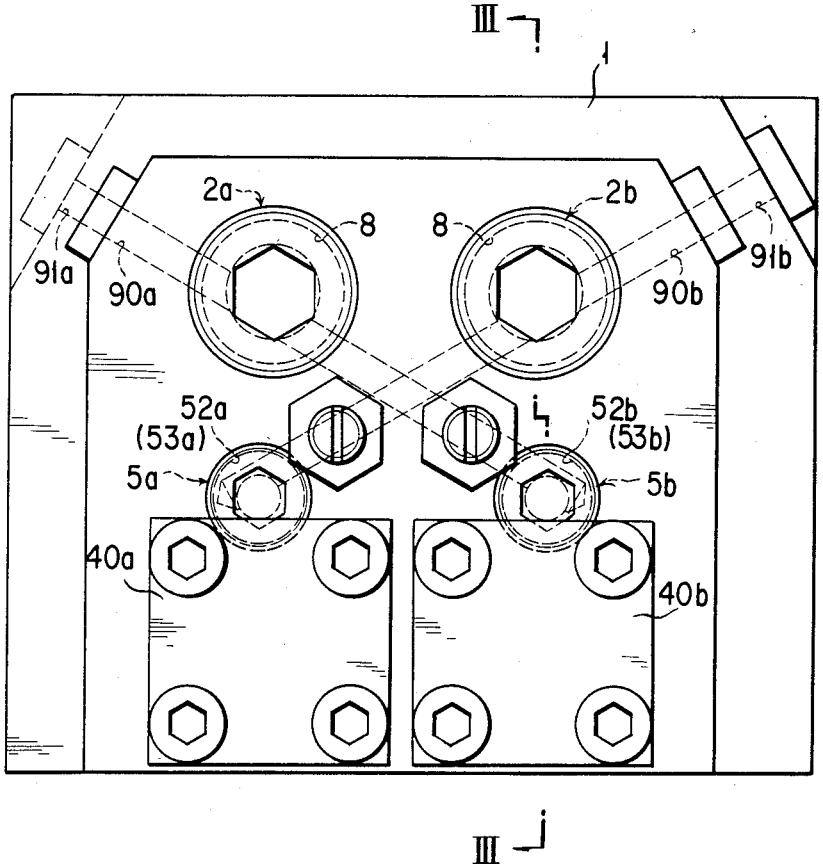
FIG. 2 is a schematic side elevational view of the valve body of the hydraulic control apparatus shown in FIG. 1.

The external appearance of valve body 1 of the hydraulic control apparatus is as shown in the plan view of FIG. 1 and in the side elevational view of FIG. 2.

Mounted within the valve body 1 are at least two sets of meter-in poppet valves 2*a*, 2*b*, and at least two sets of meter-out poppet valves 3*a*, 3*b* paired with the valves 2*a*, 2*b*. Reference numerals 40*a*, 40*b* denote proportional position action solenoids for solenoid-actuated pilot valves 4*a*, 4*b* associated with reducing valves, 5*a*, 5*b*, respectively, so as to control opening and shutting of each of the aforementioned meter-in poppet valves. The details of the arrangement of these component parts are shown in FIG. 3.

Figure 3:
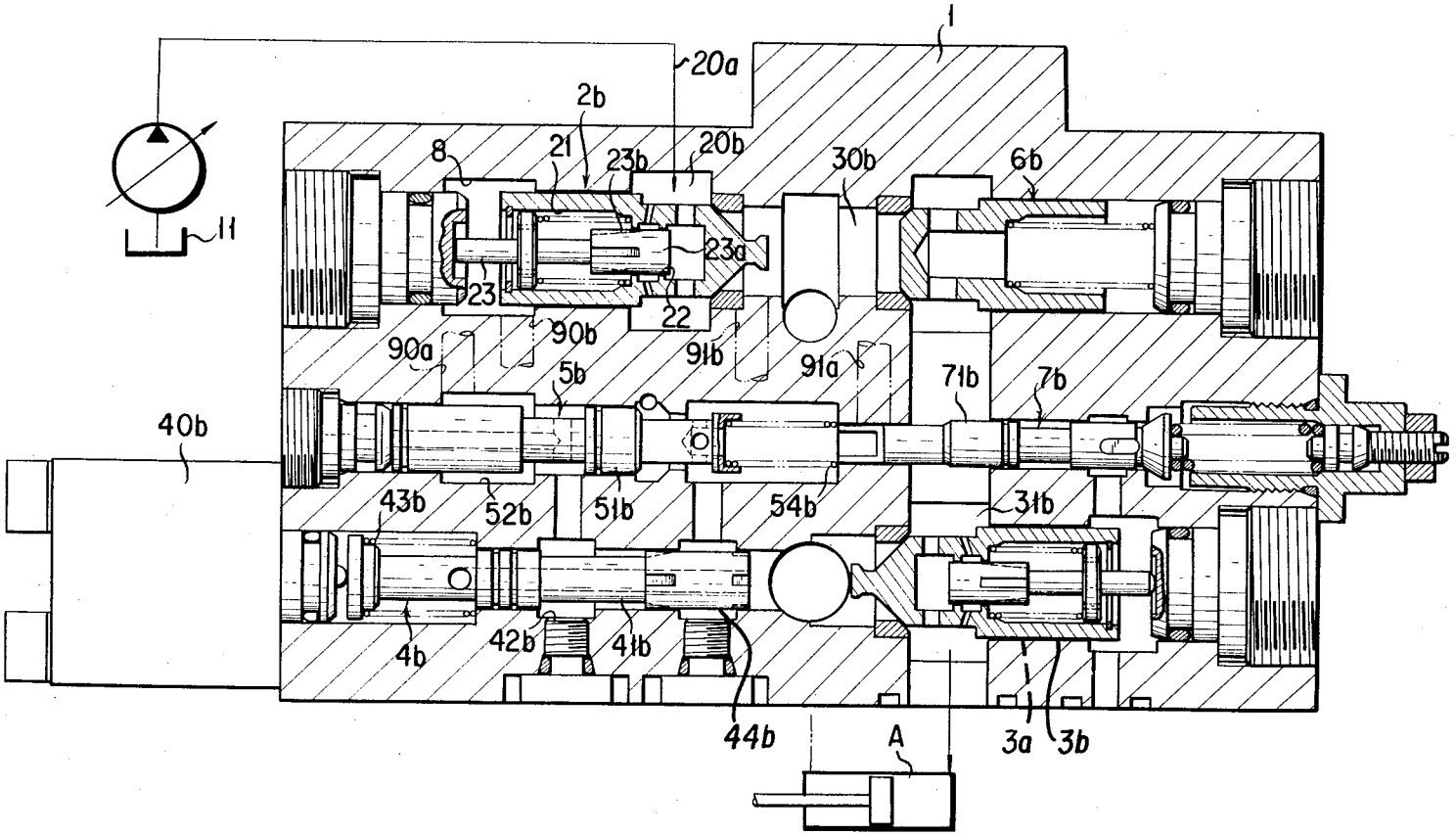
FIG. 3 is a sectional view of the valve body taken along line III—III in FIG. 2.
Figure 4:
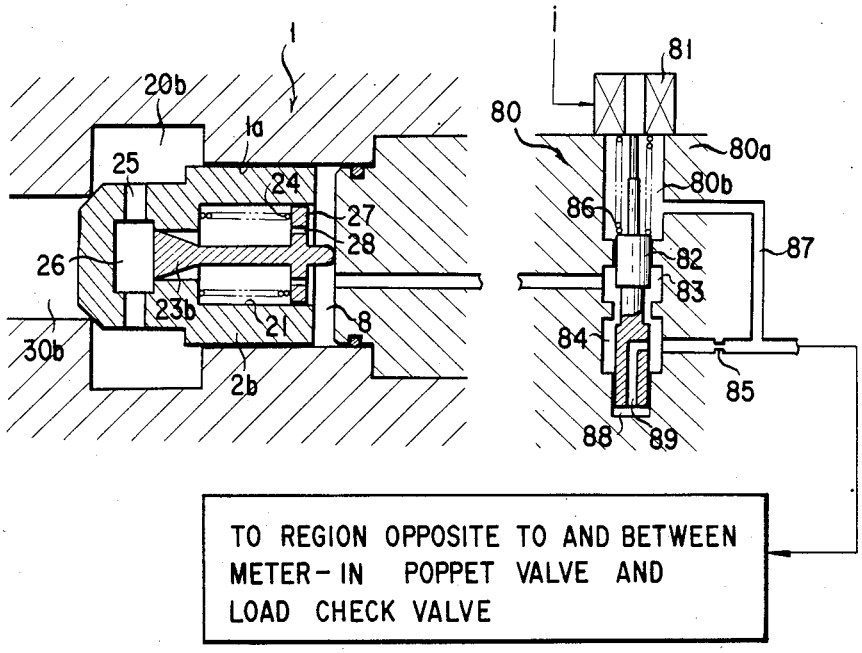
FIG. 4 is a sectional view showing a hydraulic circuit comprising a control valve means which fulfils both functions of the reducing valve and the solenoid-actuated pilot valve employed in the hydraulic control apparatus embodying the present invention.

Referring to FIGS. 3 and 4, the construction of the valve body 1 of the hydraulic control apparatus embodying the present invention will now be described in detail hereinbelow. However, it is to be noted that FIG. 3 illustrates only one side of the valve body 1, and description of the other side thereof having the same configuration is omitted herein.

Stating in brief, the valve body 1 has a second meter-in poppet valve 2*b* and a load check valve 6*b* mounted in opposed relationship with each other in an upper horizontal plane as shown in FIG. 3. Further, the above-mentioned load check valve 6*b* and a meter-out poppet valve 3*b* are vertically located in parallel relationship with each other across a pilot valve 7*b* with a piston 71*b* adapted to control the meter-out poppet valve 3*b* and which is located in between. Disposed in opposed relationship in a lower horizontal plane with the meter-out poppet valve 3*b* is a piston 41*b* slidably mounted in a solenoid-actuated pilot valve 4*b* associated with the meter-in poppet valve 2*a*. The above-mentioned pilot valve 4*b* is comprised of the pilot piston 41*b* controlled by the proportional position action solenoid 40*b*, and a piston 51*b* slidably mounted in the reducing valve 5*b*, both of which are vertically located in parallel relationship with each other. The piston 51*b* of the reducing valve 5*b* is located opposite to the pilot piston 71*b* adapted to control the above-mentioned meter-out poppet valve 3*b* in a middle horizontal plane between the upper and lower ones.

Further, although FIG. 3 shows the meter-in poppet valve 2*b*, the meter-out poppet valve 3*b* on one side of the hydraulic control apparatus and the solenoid-actuated pilot valve 4*b* adapted to control these poppet valves, it is to be noted that, in practice, as can be seen from FIGS. 1 and 2, two rows of the same arrangement are provided.

The arrangement is made such that the fluid under pressure delivered from the delivery side at the leading end of the meter-in poppet valve 2*b* is allowed to flow through the load piston slidably mounted in the load check valve 6*b* into an inlet port 31*b* on the outer peripheral side of the meter-out poppet valve 3*b*. The inlet port 31*b* is connected to at least one actuator "A".

Further, the pressurized fluid prevailing in a pressure chamber 21 defined inside the first meter-in poppet valve 2*a* is supplied into a pressure chamber 8 defined in the rear thereof, and then introduced through a passage 90*a* into an inlet port 52*b* defined in the reducing valve 5*b*. The fluid under pressure supplied into the input port 52*b* of the reducing valve 5*b* is allowed to flow through the adjacent solenoid-actuated pilot valve 4*b* again into a pressure chamber 53*b* formed in the leading end of the reducing valve 5*b*. The arrangement is also made such that the pressurized fluid supplied into the pressure chamber 53 is allowed to flow through a passage 91*a* into the leading end side of the first meter-in poppet valve 2*a*; that is, a region opposite to and between the first meter-in poppet valve 2*a* and the load check valve 6*a*. Thus, as shown in FIG. 2, the passages 90*a*, 91*a* extend along a diagonal line between the first meter-in poppet valve 2*a* and the reducing valve 5*b*. The passages 90*b*, 91*b* are also in the similar manner.

The operation of the hydraulic control apparatus will now be described below.

To render the actuator "A" operative, an operating lever not shown is operated to thereby supply the pressurized fluid from a variable displacement pump 11 into an inlet port 20*a* formed in the first meter-in poppet valve 2*a*. Further, the pilot valves 4*b* and 7*b* associated with the meter-in poppet valve 2*b* and the meter-out poppet valve 3*b*, respectively, are also rendered operative at the same time, thereby to open the poppets slidably mounted in the poppet valves. Stating in more detail, the inlet port 20*a* of the first meter-in poppet 2*a* communicates with the spring chamber 21 through a restricted clearance defined between a valve bore 22 formed inside the first poppet valve 2*a* and a large diameter portion 23*a* of a metering pin 23 loosely fitted in the bore 22. Next, if the proportional position action solenoid 40*b* is energized under this condition, the pilot piston 41*b* will move against the biasing force of a compression spring 43*b*. This movement allows the poppet portion 44*b* of the pilot piston 41*b* to open thus lowering the fluid pressure within inlet port 52*b* formed in the reducing valve 5*b*. Thus, the piston 51*b* of the reducing valve 5*b* is moved to the left in the drawing by the biasing force of a compression spring 54 to enable the inlet port 52*b* to communicate with an exhaust port 53*b*. As a result, the fluid pressure within the pressure chamber 8 of the first meter-in poppet 2*a* will drop to cause a pressure differential between the inlet port 20*a* and the pressure chamber 8 which is sufficient to open the poppet valve 2*a*. Thus, the meter-in poppet valve 2*b* will move to the left in the drawing thereby to allow the pressurized fluid to flow from the inlet port 20*a* into a secondary port 30*a* on the leading end side of the first meter-in poppet valve 2*a*.

The degree of opening of the first meter-in poppet valve 2*a* varies with the amount of pressure drop within the pressure chamber 8. When the degree of the poppet opening becomes excessive, the variable restrictor 23*b* of the metering pin 23 permits communication between the inlet port 20*a* and the pressure chamber 8 without any restriction, thus eliminating the pressure difference prevailing between them. As a result, the first meter-in poppet valve 2*a* will be moved back in the valve closing direction (to the right in the drawing) due to the difference in the pressure receiving area of the poppet itself.

Whilst, the piston 51*b* of the reducing valve 5*b* senses the fluid pressure within the exhaust port 53*b* and opens the piston 41*b* of the solenoid-actuated pilot valve 4*b* to thereby adjust the pressurized fluid flowing out from the inlet port 52*b* into the inlet port 42*b* of the pilot valve 4*b*. Therefore, even if the fluid pressure supplied by the variable displacement pump 11 into the inlet port 20*a* of the first meter-in poppet valve 2*a* fluctuates, it is possible to make compensation to maintain the fluid flowing out from the inlet port 20*a* into the secondary port 30*a* at a constant flow rate.

While, in the above-mentioned embodiment, a pair of each of the solenoid-actuated pilot valve and each of the reducing valves, both of which are located in parallel relationship, is employed to control opening and shutting of the meter-in poppet valve, FIG. 4 illustrates a compact and simplified valve means which fulfils both the functions of these two valves.

With reference to FIG. 4, the meter-in poppet valve 2*b* has a spring chamber 21 formed therein and in which a compression spring 24 is located, one end of the compression spring 24 abutting against the inner bottom of the spring chamber 21 to urge the poppet valve 2*b* in the closing direction. Further, slidably mounted in the poppet valve 2*b* is a metering pin 23 which serves to establish and cut off communication between a pressure chamber 26, which communicates through a passage 25 with the inlet port 20*b*, and the spring chamber 26, and to restrict the fluid pressure by means of a variable restrictor portion 23*b*. Further, the leading end of the metering pin 23 projecting into the spring chamber 21 has a spring retainer seat 27 having through bores 28 against which the other end of the compression spring 24 abuts.

Whilst, the pressure chamber 8 which communicates through the through-bores 28 with the spring chamber 21 is connected to a solenoid-actuated pilot valve unit 80. The pilot valve unit 80 has a valve body 80*a* in which is accommodated a pilot spool 82 adapted to be operated by a solenoid 81. The aforementioned pilot spool 82 has formed therein a port 83 leading to the aforementioned pressure chamber 8 and a port 84 which communicates through a fixed restrictor 85 with the delivery side of the leading end of the meter-out poppet valve. The pilot spool 82 is biased by the resilient force of a compression spring 86 contained in the spring chamber 80*b* in the valve closing direction. The spring chamber 80*b* is connected by way of a passage 87 to the delivery side of the leading end of the meter-out poppet valve. Further, the end portion of the pilot spool 82 opposite to the solenoid 81 is formed with a passage 89 which allows to communicate a chamber 88 with the port 84.

Next, the operation of the pilot valve unit 80 will be described. When a command electric current "i" is allowed to flow through the solenoid 81 to energize it, the pilot spool 82 is moved against the biasing force of the compression spring 86 to allow the port 83 to communicate with the port 84 to thereby permit the hydraulic fluid under pressure in the pressure chamber 8 defined behind the meter-in poppet valve 2*b* to flow through the fixed restrictor 85 into the delivery side of the leading end of the meter-out poppet valve. In consequence, the fluid pressure in the pressure chamber 8 will drop so as to move the meter-in poppet valve 2*b* to the right to connect the inlet port 20*b* with the secondary port 30*b* thereby causing the pressurized fluid flow from the inlet port 20*b* into the secondary port 30*b*.

Figure 5:
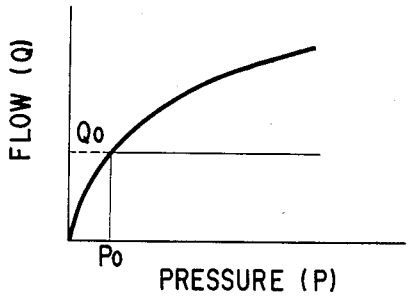
FIGS. 5 to 7 are diagrams showing the effects obtained by the control valve means shown in FIG. 4.
Figure 6:
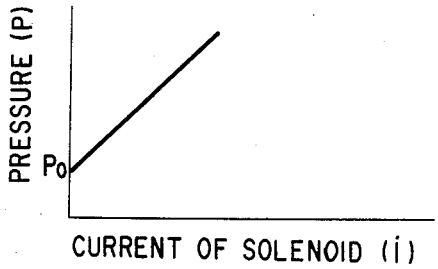
Figure 7:
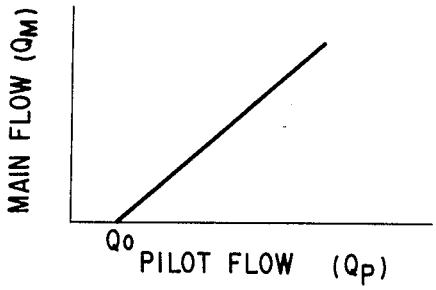

FIG. 5 shows the relationship between the pilot fluid flow rate Q and the output produced by the reducing valve. FIG. 6 shows the relationship between the command electric current "i" and the output pressure P. Further, FIG. 7 shows the relationship between the main fluid flow rate $Q_M$ and the pilot fluid flow rate Q. As can be seen from FIG. 5, the output pressure P from the reducing valve is proportional to square of the pilot fluid flow rate Q. Further, as is obvious from FIG. 7, the main fluid flow rate $Q_M$ is kept at zero until the pilot fluid flow rate reaches a predetermined value $Q_o$. This is made to ensure that the meter-in poppet valve 2*b* is seated correctly. Therefore, as shown in FIG. 6, regarding the relationship between the electric current "i" flowing through the solenoid and the output pressure P, an offset quantity $P_o$ is previously set. Thus, since the control on the main fluid flow rate $Q_M$ starts at the pilot fluid pressure $P_o$ and the flow rate $Q_o$, it becomes possible to effect controls to maintain an approximate linear relationship between the flow rate and the fluid pressure.

It is to be understood that the foregoing description is merely illustrative of preferred embodiments of the present invention and that the scope of the invention is not to be limited thereto. Additional modifications or alterations of the invention will be readily occur to those skilled in the art without departing from the scope of the invention as set forth in the appended claims.

What is claimed is:

1. A hydraulic control apparatus comprising at least two sets of meter-in poppet valves mounted in a valve body in such a manner that the outer peripheral sides of the poppet valves are located in their respective hydraulic fluid supply ports communicating with a variable displacement pump; at least two sets of meter-out poppet valves whose outer peripheral sides are located in their respective secondary inlet ports, with each of which the delivery side at the leading end of the meter-in poppet valves is allowed to communicate through a load check valve, each of said meter-out poppet valves being mounted in the valve body to form a pair with each of said meter-in valves; solenoid-actuated pilot valves each being associated with each of said meter-in poppet valves in cooperation with a reducing valve, said solenoid-actuated pilot valves each being adapted to be actuated so as to open and shut each of said meter-in poppet valves freely; and pilot valves each being associated with each of said meter-out poppet valves so as to control the fluid pressure within each of said meter-out poppet valves, the outer peripheral sides of said meter-out poppet valves being connected to at least one actuator, characterized in that pair of each of said meter-in poppet valves and each of said load check valves which are disposed in an upper horizontal plane, pair of each of said meter-out poppet valves and each of the solenoid-actuated pilot valves associated respectively with said meter-in poppet valves each of which is arranged at the opposite side to each of the solenoid-actuated pilot valves, this pair of valves being disposed in a lower horizontal plane, and pair of each of the pilot valves associated respectively with said meter-out poppet valves and each of the reducing valves associated respectively with said meter-in poppet valves each of which is arranged at the opposite side to each of the reducing valves, this pair of valves being disposed in a middle horizontal plane between said upper and lower ones are each located in opposed relationship to each other, and each of said load check valves vertically is located in parallel relationship with each of said meter-out poppet valves, the arrangement being made such that the fluid pressure within one of said meter-in poppet valves is allowed to be directed into the inlet port of one of the reducing valves associated with the other meter-in poppet valve and flow through the solenoid-actuated valve associated with said one of the reducing valves back again into the leading end of the latter from where it is allowed to flow into the region opposite to and between said one of said meter-in poppet valves and one of said load check valves.

2. A hydraulic control apparatus as claimed in claim 1, characterized in that the passage for directing the fluid pressure within each of said meter-in poppet valves into the region opposite to and between said one of the meter-in poppet valves and said one of the load check valves extends along a diagonal line between said one of the meter-in poppet valves and one of the reducing valves which is arranged at the opposite side to said one of the meter-in poppet valves.

3. A hydraulic control apparatus as claimed in claim 1, characterized in that a control valve means comprising a pilot spool adapted to be controlled for movement between an inlet port communicating with a pressure chamber within each of said meter-in poppet valves and another port communicating through a fixed restrictor with the region opposite to and between each of said meter-out poppet valves.

* * * * *